United States Patent [19]

Kündig

[11] 4,344,571

[45] Aug. 17, 1982

[54] SELF-CONTAINED DEVICE FOR SPRAYING A HEATED SPRAY MATERIAL

[76] Inventor: Armin Kündig, Eichstr. 4, 8620 Wetzikon, Switzerland

[21] Appl. No.: 211,455

[22] Filed: Nov. 28, 1980

Related U.S. Application Data

[63] Continuation of Ser. No. 33,415, Apr. 26, 1979, abandoned.

[51] Int. Cl.[3] ..... B05B 1/24

[52] U.S. Cl. ..... 239/130; 239/134; 239/139; 239/142; 239/175

[58] Field of Search ..... 239/130, 132, 134, 139, 239/142, 172, 175

[56] References Cited

U.S. PATENT DOCUMENTS

| | | | |
|---|---|---|---|
| 1,694,806 | 12/1928 | Yale | 239/130 |
| 2,802,601 | 8/1957 | Berry | 239/130 |
| 3,086,713 | 4/1963 | Moldenhauer | 239/130 |
| 3,243,123 | 3/1966 | Inghram et al. | 239/130 |
| 3,481,544 | 12/1969 | Jackson | 239/130 |
| 4,238,072 | 12/1980 | Licursi | 239/142 |

FOREIGN PATENT DOCUMENTS

| | | | |
|---|---|---|---|
| 179600 | 9/1954 | Austria | 239/134 |
| 50644 | 10/1966 | German Democratic Rep. | 239/130 |
| 327116 | 4/1930 | United Kingdom | 239/134 |

*Primary Examiner*—Robert B. Reeves
*Assistant Examiner*—Michael J. Forman
*Attorney, Agent, or Firm*—Donald D. Denton

[57] ABSTRACT

A portable self-contained device for heating and spraying a coating material from a tank onto a surface, the device having a fluid fuel supply for heating the material, which fuel in addition to heating drives an engine that is coupled to a generator device for supplying electrical energy to heating elements in a spray hose and nozzle that communicate with the tank and to a main pump which causes a fluid medium to circulate to drive a stirring engine which operates a stirring apparatus in the tank, and to drive a discharge pump for discharging heated material through the spray hose and nozzle operatively connected to it.

6 Claims, 1 Drawing Figure

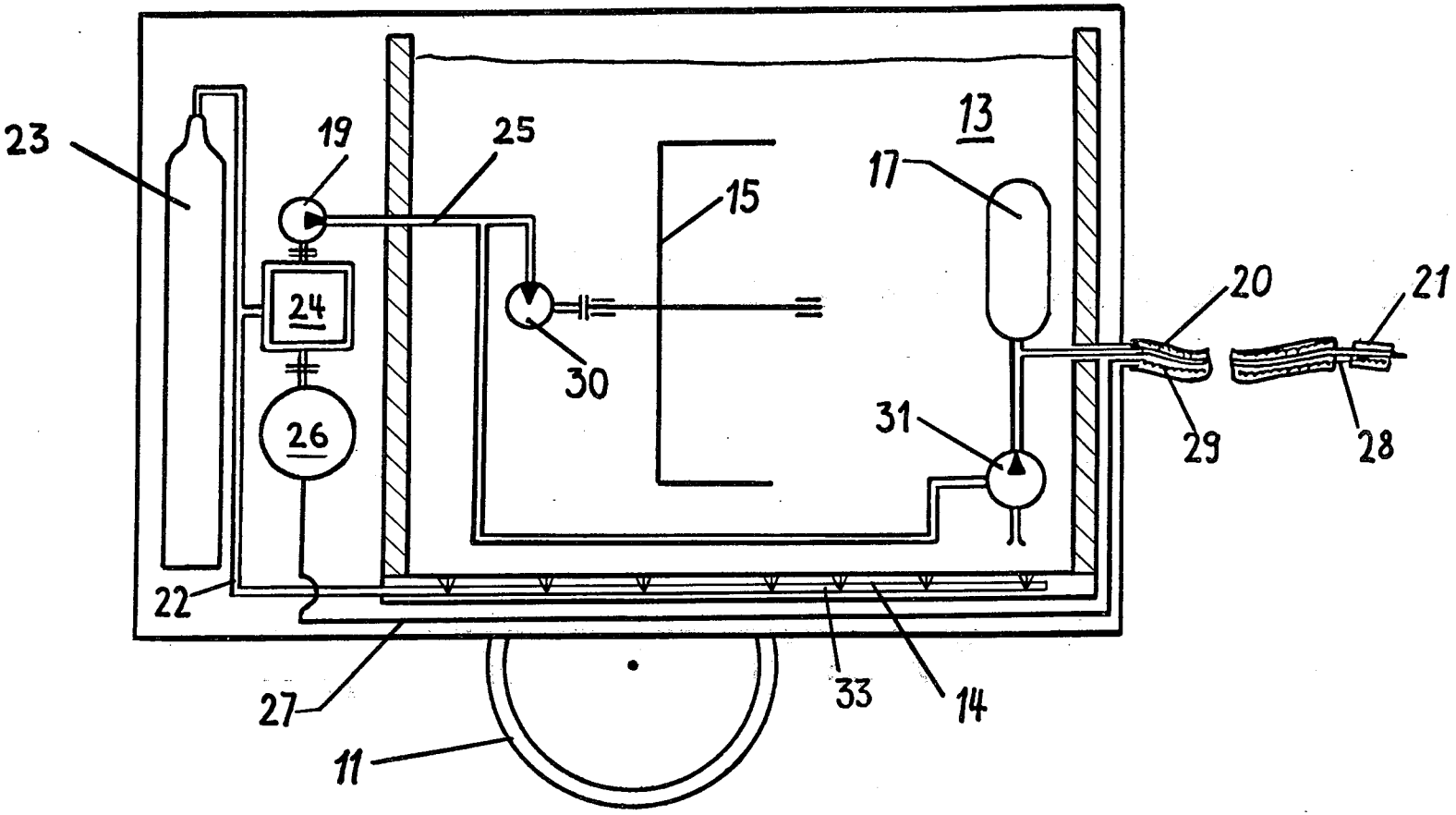
21
28
20
29
13
17
31
14
33
15
30
25
19
24
26
11
27
22
23

SELF-CONTAINED DEVICE FOR SPRAYING A HEATED SPRAY MATERIAL

BACKGROUND OF THE INVENTION

This is a continuation of application Ser. No. 033,415 field Apr. 26, 1979, now abandoned, which in turn relates to a device for spraying a heated spray material on a surface, which device is a self-contained, movable unit comprising a heatable container containing the spray material, a pump, an engine for driving said pump, a flexible electrically heated conduit for the spray material leading to a spray nozzle and a supply of fuel for heating the container, wherein the fuel, in addition to heating the container, also serves for driving the engine.

Basically, there are two industrial methods for applying thin coating of thermoplastic materials such as bitumens, resins, waxes, pitches, tars, asphalts, and the like. These materials, which are solid at normal temperatures, can either be made fluid by heating and be used while hot; or they can be made fluid by adding solvent of an emulsifying agent and thereby be used by cold spraying devices. The disadvantages of the latter method is that the obtainable thickness of the coating is very thin and the dried coating is very permeable because the evaporating solvents leave pores. Therefore, several coats have to be applied, each one after a sufficient drying time. This method, sometimes not even usable because of the fumes of the solvents, is time consuming, depends on the weather conditions, and is expensive because the solvents are much more expensive than the coating material itself.

On the other hand, if the pure spray materials are heated and applied with brushes or spatulas by hand, an excellent protection will be achieved, but the procedure is troublesome, especially for surfaces not easily accessible or when vertical walls have to be coated because the material cools while it is being applied.

Only the hot spraying method combines the advantages of the two methods (large hourly productivity with the cold spraying method, excellent protective property with the hot pasting method), but it has been quite troublesome up to now. The materials have had to brought to the spraying device, from which they are applied by a pump through a conduit or hose to the desired surface. The fuel (coal, oil or gas) for the preparation and the spraying of the material, together with cables for the electrical current or pipes for compressed air for the engine have to be fetched individually. Even for short distances, the transport of the hot material is cumbersome. In particular, there is the danger that spray material cools down and becomes solid in the conduit leading from the tank to the spraying nozzle.

Whenever a long hose is required to serve as a conduit, it is known to utilize heating elements embedded in the conduit and being supplied with current from a network source. An auxiliary electrical connection to a network has always the disadvantage that it has to be made solely for this purpose, that it is temporary, dangerous, obstructs the working conditions and might inadvertently be damaged. In addition, such a connecting cable drastically reduces the movability of the spraying unit.

Very often the conditions for spraying an area are such that a connection to the electrical network can only be made with great effort and at high cost, or that a connection is not possible at all, as for instance in a building under construction, on a roof, on a bridge or in a pit.

There is known a spraying unit in which the gas used for heating the spray material is also used for driving the engine, which is coupled over gear wheels with the pump moving the spray material. In this unit an electrical connection for driving a motor or a compressor for supplying compressed air is not necessary. But in this known construction, one still depends on an electrical connection to the network, if the flexible hose leading to the spraying nozzle has a certain length and has to be heated.

SUMMARY OF THE INVENTION

The above mentioned disadvantages are avoided by the present invention, which is characterized in that the spraying unit, in addition, comprises a generator drivable by said engine for producing electrical energy for heating the conduit.

In the following an embodiment of the invention is described and illustrated in the FIGURE of the drawing which shows diagrammatically a vertical arrangement of the component parts that cooperate to form the improved spraying device in accordance with the invention.

DESCRIPTION OF THE PREFERRED EMBODIMENT

A self-contained spraying device or unit 10 is mounted on a set of wheels 11 (only one shown) which provides portability of the unit. It will be appreciated that other wheel arrangements may be used to make the spraying device portable. The self-contained unit has a heatable tank or heating container 14 positioned in the spraying device 10 which contains the sprayable material 13 to be heated. The container 14 is heatable with a heating device or means. Inside the container tank 14 are positioned a stirring apparatus 15 operated by a stirring pump 30, a discharge pump means 31 operatively connected to a pressure compensation tank 17. The sprayable material 13 in heated condition is delivered by the discharge pump means 31 into the pressure compensation tank 17. From the latter it is moved through a hose or conduit 20, forming a conduit for the sprayable material through a spray nozzle 21 which is the means for directing the material 13 from tank 14 onto a surface to form a coating thereon.

The heating device 33 receives the fuel for heating the tank 14 in the form of a fluid such as oil or gas from a fuel supply tank or cylinder 23 through a fuel conduit 22. A suitable control means, such as a valve and/or a pressure regulator 18 can be employed in conduit 22 to stop and start the flow of fuel. An engine or motivating means 24 is driven by the same fuel that comes from the supply tank 23 through the conduit 22. The engine 24 drives a main pump or means 19 which causes a fluid medium to circulate in a tube 25, by which medium a hydraulic or pneumatic fluid stirring pump 30 is driven to operate the stirring apparatus 15 and also the discharge pump or means 31, both pumps being driven either hydraulically or pneumatically. The discharge pump means 31 when operating delivers heated material 13 from heating tank 14 to conduit 20 and then through nozzle 21.

Moreover, according to the invention, the engine 24 is coupled with an electric generator means 26, and when driven, supplies the motivating force for driving the generator means. The generator means is operably connected to an electrical cable 27 which supplies current to a heating element 29 embedded in the flexible conduit 20 for producing heat when said engine means 24 is in operation. Another cable 28 may be embedded in the nozzle to supply heating current from the generator to the spraying nozzle 21 so that the spray nozzle remains heated as well as the conduit 20.

In operation of the spraying device, the hose or conduit 20 is electrically heated. With regard to the risk of a solidification of the spray material in the conduit 20, one is therefore free in the choice of any length of the conduit necessary to reach the surface to be sprayed. One is not dependent on an outside electrical network or system for maintaining the hose and nozzle heated. Consequently, the spraying unit does not need a connecting electrical cable, which would restrict movement of the device 10 and obstruct the working area.

It will be appreciated that the rotational speed of the engine 24 has to be adjusted with respect to the generator means 26 so that its output in electrical energy is adjusted such that the conduit 20 is heated to the desired temperature. Too much variation in engine speed must be avoided as a result of, for example, different degrees of viscosity of the coating material. In the present example this is accomplished by driving the stirring apparatus 15 and the pump 31 hydraulically or pneumatically. By operating in such a way, different resistances at the discharge pump 31 and at the stirring apparatus 15 are compensated for by the slip that is inherent in a drive with a fluid medium. In this manner the speed of rotation of the engine 24 and therewith the generator 26 is kept practically constant.

Also, the end of the fuel conduit 22 that enters the container 14 may have any standard type burner nozzle means so that the fuel can be ignited to burn properly for heating the contents of the container when use is desired.

It will be appreciated that suitable means are incorporated in device 10 that will allow for firing of the device when fuel is passed from the supply cylinder 23 to the container 14 so that the material 13 in the container 14 is maintained at the desired temperature for spraying which of course can be monitored by conventional thermostatic means. Also, the fuel tank 23 may have a standard disconnet means 32 for replacing a fuel cylinder after all the fuel in it has been used. The fuel, of course, can be either a gas or a liquid.

Container 14 may be insulated in a conventional manner so that heat produced by the burning of fuel from supply means 23 can be efficiently transferred to the material 13 in the container 14 and heat losses to the outside reduced.

Advantageously, the stirring apparatus 15 can be of any convenient form and so positioned that it will effectively stir the material 13 when operated by engine 30.

Also, suitable handles or attachment lugs can be positioned on the device 10 for conveniently moving the device from one place to another.

What is claimed is:

1. A movable self-contained device for melting and spraying a heated sprayable material on a desired surface, the sprayable material at normal temperatures being in a solid state, comprising: a portable body support member having positioned thereon a heatable container adapted to hold the sprayable material; a main pump means; an engine means operatively connected to said main pump means for driving said main pump means, said main pump means being operatively connected to a discharge pump means and a stirring apparatus, both positioned in said container for agitating the heated sprayable material when heated and discharging the heated material from said container; a flexible electrically heatable conduit having a spraying nozzle at the free end thereof and being connected at its other end to said discharge pump means, said discharge pump means being adapted to force said heated material through said conduit and nozzle when said material is in a heated condition; a fluid fuel supply means for supplying a fluid medium both for heating said container to change said solid material to a sprayable state and for driving said engine means; and an electric generator means operatively connected to and drivable by said engine means, said generator means being electrically connected to said heatable conduit to electrically energize said heatable conduit and heat it during the operation of said device.

2. The device according to claim 1 in which said spraying nozzle is electrically heatable by the electrical energy produced by said generator means.

3. The device according to claim 1 in which said heatable conduit is a hose having embedded in the wall thereof an electrical heating means electrically connected to said generator means for heating the conduit during operation of said device.

4. The device according to claim 1 in which said discharge pump and the stirring apparatus positioned within said heatable container for agitating the heated sprayable material are drivable with a fluid medium, which is driven by said main pump.

5. The device according to claim 4 in which said fluid medium is a liquid.

6. The device according to claim 4 in which said fluid medium is a gas.

* * * * *